US008523629B2

(12) United States Patent
Pundyk

(10) Patent No.: US 8,523,629 B2
(45) Date of Patent: Sep. 3, 2013

(54) VARIABLE COMPRESSION HYBRID DESIGN SPORTS BRA

(75) Inventor: Jon R. Pundyk, New York, NY (US)

(73) Assignee: Glamorise Foundations, Inc., New York, NY (US)

( * ) Notice: Subject to any disclaimer, the term of this patent is extended or adjusted under 35 U.S.C. 154(b) by 350 days.

(21) Appl. No.: 13/072,071

(22) Filed: Mar. 25, 2011

(65) Prior Publication Data

US 2012/0244782 A1 Sep. 27, 2012

(51) Int. Cl.
*A41C 3/00* (2006.01)

(52) U.S. Cl.
USPC ..... 450/36; 450/30; 450/33

(58) Field of Classification Search
USPC ..... 450/36, 30–33, 7–11; 2/104–106, 2/113–115
See application file for complete search history.

(56) References Cited

U.S. PATENT DOCUMENTS

| | | | | |
|---|---|---|---|---|
| 2,127,927 | A * | 8/1938 | Raleigh | 450/36 |
| 2,149,819 | A | 3/1939 | Rubinstein | |
| 2,400,499 | A | 4/1942 | Gerace | |
| 2,508,704 | A | 5/1950 | Becker | |
| 2,835,255 | A | 5/1958 | Becker | |
| 5,221,227 | A | 6/1993 | Michels | |
| 5,643,043 | A | 7/1997 | Pflum | |
| 5,863,236 | A | 1/1999 | Johnson | |
| 6,116,985 | A | 9/2000 | Lambert | |
| 6,755,717 | B2 | 6/2004 | Smith | |
| 6,839,908 | B2 * | 1/2005 | Schneider et al. | 2/73 |
| 6,855,029 | B2 * | 2/2005 | Rothman | 450/36 |
| 7,076,809 | B2 * | 7/2006 | Rothman | 2/104 |
| 7,435,155 | B2 | 10/2008 | Reinisch et al. | |
| 2001/0019933 | A1 | 9/2001 | Wagner | |
| 2009/0098803 | A1 | 4/2009 | Reinisch | |

* cited by examiner

*Primary Examiner* — Gloria Hale
(74) *Attorney, Agent, or Firm* — Stites & Harbison PLLC; Douglas E. Jackson

(57) ABSTRACT

A variable compression hybrid design sports bra offers both compression and encapsulation to support the breasts of a user. The front member of the bra includes a rib band extending across the front, and left and right cups connected at bottom portions thereof to the rib band so as to extend above the rib band. The front member also includes a shaped compression panel or bust cup which receives the left and right cups therein. This compression panel is made of an elastic material, is connected to the rib band at a lower portion thereof, and has left and right upper front portions extending from a main portion thereof. An attachment system or mechanism adjustably attaches the compression panel with a strap system to adjustably stretch the compression panel over and thus compress the left and right cups. The cups are supported by crossing slings.

19 Claims, 5 Drawing Sheets

VARIABLE COMPRESSION HYBRID DESIGN SPORTS BRA

BACKGROUND OF THE INVENTION

Women engaged in sports or the like activities typically use special brassieres (or bras) to support their breasts and thus avoid excessive movement and/or bounce due to the activities or motions associated with such sports. Modern sports bras typically employ one of two designs to provide extra support: encapsulation or compression. Encapsulation designs (typically molded designs) provide a more natural shape and better definition of the breasts, while compression designs are better at minimizing bounce of the breasts. Many encapsulation designs also use under-wires to offer extra shaping and support to the bust, with a loss of comfort that results from adding an inflexible support to a bra designed for use when the user's body including the breasts are in motion.

Most sports bras are designed with either a racer back designed to offer back support and keep straps in place, or a conventional back that offers the best adjustment of the individual back straps and ease of wearing but which has reduced back support.

All sports bras are designed with specific degrees of support or compression, based upon the nature of the intended activities or motion. High impact activities such as running require high compression to minimize bounce, while low impact activities such as yoga require only low compression to minimize bounce. Further, each woman has her own preference as to how much compression and resulting bounce is appropriate, desirable and/or comfortable. Bras designed for compression typically only offer a fixed amount of compression for a given garment. Bras of this type are characterized as high, medium, or low compression garments based on their design.

BRIEF SUMMARY OF THE INVENTION

In view of the disadvantages of most sports bras and the like as noted above, it will be noted that the sports bra of the present invention advantageously provides a hybrid design which offers both compression and encapsulation to support the breasts of a user. This compression and supporting system is preferably achieved via an inner cup supporting system and an outer bust supporting system. This hybrid design further allows the user to easily set and adjust the amount of compression at the time of activity as desired, or thereafter as desires may change, for maximum control and comfort.

It is also an advantage of the sports bra of the present invention that this hybrid design also uses a sling support within the inner cup supporting system to offer the shaping and support of a wire, but without using any wires typically found in the prior art. This sling support offers optimal shaping, without the discomfort of a wire normally needed for this support. It will be appreciated that this sling support of the cups distributes support across the body and angularly to the opposing strap and shoulder for greatest comfort.

It is a further advantage of the sports bra of the present invention that the outer bust supporting system provides additional support and compression via the shaped compression panel over that normally present in sports bras. It will be appreciated that this additional support provided by the compression panel is directed vertically, which is advantageous in thereby distributing the support vertically and mostly to the corresponding strap and shoulder.

It is a still further advantage of the present invention that each breast is supported by both straps and hence both shoulders, vertically and angularly, allowing better and more balanced support. By supporting each breast by both straps, advantageous support is provided during user motions since the load pattern of the bust changes with the motions of the body.

It is a still further advantage of the sports bra of the present invention over prior art sports bras that the outer bust supporting system allows a user to continually set and/or change the amount of compression at the time of wearing. This adjustment feature also permits the user to vary the amount of extra compression for each side as desired, to reflect the typical asymmetrical size of the user's breasts and/or to reflect any subjective preference which might be depending upon the activity of the user.

It is a still further advantage of the sports bra of the present invention that the two-way stretch back member successfully distributes the load originating from both the inner cup supporting system and the outer bust supporting system. The two-way stretch back member integrates to the cups to offer support, security, and comfort during motion; while at the same time the back member offers the support of a racer back, with the desirable length adjustment of a conventional back member.

It is a still further advantage of the sports bra of the present invention that, due to the variable compression construction of the outer bust supporting system, a single brassiere has low, medium, and high (or more) compression options which the user can easily adjust. The sports bra of the invention thus allows the user to use one bra for many activities, and is of special note for users who might do multiple activities in a single wearing where different compression options are needed for one or more of the multiple activities. Further, the variable compression feature allows each user to adjust the amount of compression to their own specifications based on the intended activity, personal preference, and/or body shape.

In accordance with the sports bra of the present invention, there is described hereafter a variable compression hybrid design sports bra is provided broadly having a back member which extends across a back of the user and a front member which extends across the chest of the user. The back member has left and right back ends or end portions. The front member includes left and right front sides which are respectively attached to the left and right back ends of the back member. The front member also includes a rib band extending from the left front side to the right front side, and left and right cups which receive a respective left and right breast of the user therein and which are connected at bottom portions thereof to the rib band so as to extend above the rib band. The front member also includes a shaped compression panel or bust cup which conformingly covers and hence receives the left and right cups therein during use. This shaped compression panel is made of an elastic material, is connected to the rib band at a lower portion thereof, and has left and right upper front portions extending from a main portion thereof. The sports bra also broadly includes a shoulder strap system which connects the left and right cups to the back member, and an attachment system or mechanism which adjustably attaches the left and right upper portions of the compression panel with the strap system to adjustably stretch the shaped compression panel attached to the rib band over the left and right cups and thus to compress the left and right cups during use.

It is a feature of one preferred embodiment of the sports bra that the left and right cups are made of a relatively less (or non) elastic material while the compression panel is made of a relatively elastic material which has a higher elastic modulus or restoring force than the less elastic material of the left and right cups. Preferably the cups are made from a mold material which can be rigid, semi-rigid or mildly stretchable, and thus the compression panel is made of a material which has a higher elastic modulus or restoring force than that of the cups. In addition, as desired, the relatively non-elastic material of the cups is preferably made of a material which has moisture management properties (e.g., suitable moisture transparency or wicking proprieties); while the compression panel preferably includes breathing holes in at least a central portion thereof as well as likewise having moisture management properties (e.g., suitable moisture transparency or wicking proprieties).

It is a feature of another or a combination of preferred embodiments that the strap system includes left and right chest straps or chest and back portions, and also that the left and right cups include respective left and right slings. These left and right slings effectively cross one another at a central intersection so that they are attached angularly to the respective right and left chest straps. The left and right slings respectively further extend from the central intersection to underneath and around each respective right and left cup, to further support the associated cup with support coming angularly from the (opposite) right and left straps.

It is a feature of another or a combination of preferred embodiments that the shoulder strap system is made of a relatively inelastic material and that the back member includes left and right back bands which are made of a relatively elastic material which has a higher elastic modulus or restoring force than the non-elastic material of the strap system. The left and right back bands terminate in respective left and right back ends. In addition, the left and right back bands further include left and right back extensions which extend vertically from a respective left and right back band, which are attached at an upper end thereof to the strap system, and which are made of a relatively elastic material which has a higher elastic modulus or restoring force than the relatively inelastic material of the strap system. With this constructions, there is thus provided a two way planar stretching of the back member in use relative to the strap system.

It is a feature of another or a combination of preferred embodiments that the attachment system includes left and right chest straps which individually adjusts the left upper portion of the compression panel with the left chest strap and the right upper portion of the compression panel with the right chest strap. In addition, a length of the shoulder strap system is adjustable and a length of the back member is adjustable.

Other features and advantages of the present invention are stated in or apparent from detailed descriptions of presently preferred embodiments of the invention found hereinbelow.

DETAILED DESCRIPTION OF THE INVENTION

Figure 1:
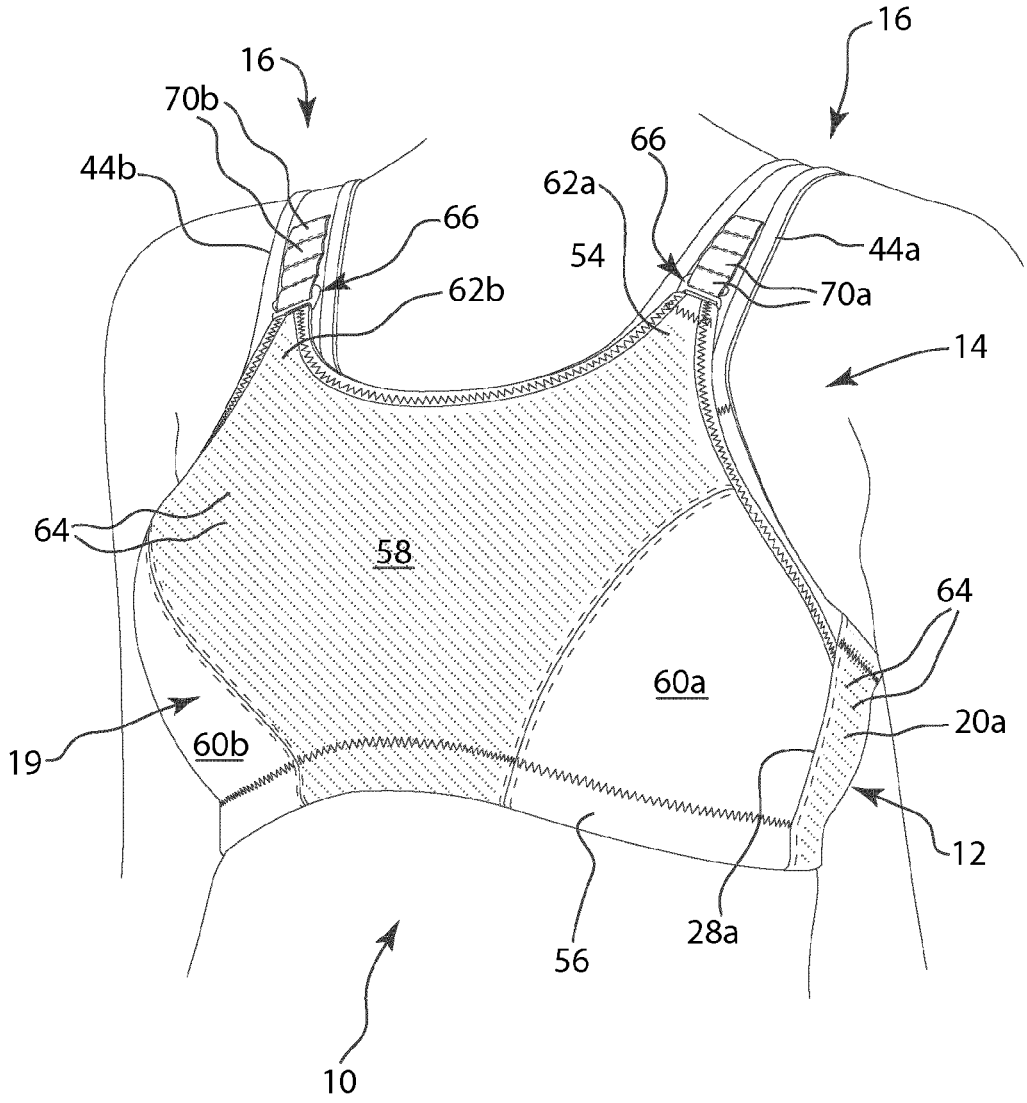
FIG. 1 is a front and left perspective view of the sports bra of the present invention.

With reference now to the drawings in which like numerals represent like elements throughout the views, a variable compression hybrid design sports bra 10 according to the present invention is depicted in FIGS. 1-5. Sports bra 10 is designed to offer both compression and encapsulation to support the breasts of a user in a comfortable and easily adjusted manner. Generally, sports bra 10 includes a back member 12, a front member 14, and a strap system 16, all of which are suitably attached together or integral with one another as by stitching or the like as well known in the art. Front member 14 includes an inner supporting cup system 18 and an outer bust supporting system 19 to provide both angular and non-angular support as will be more fully described hereafter.

Figure 3:
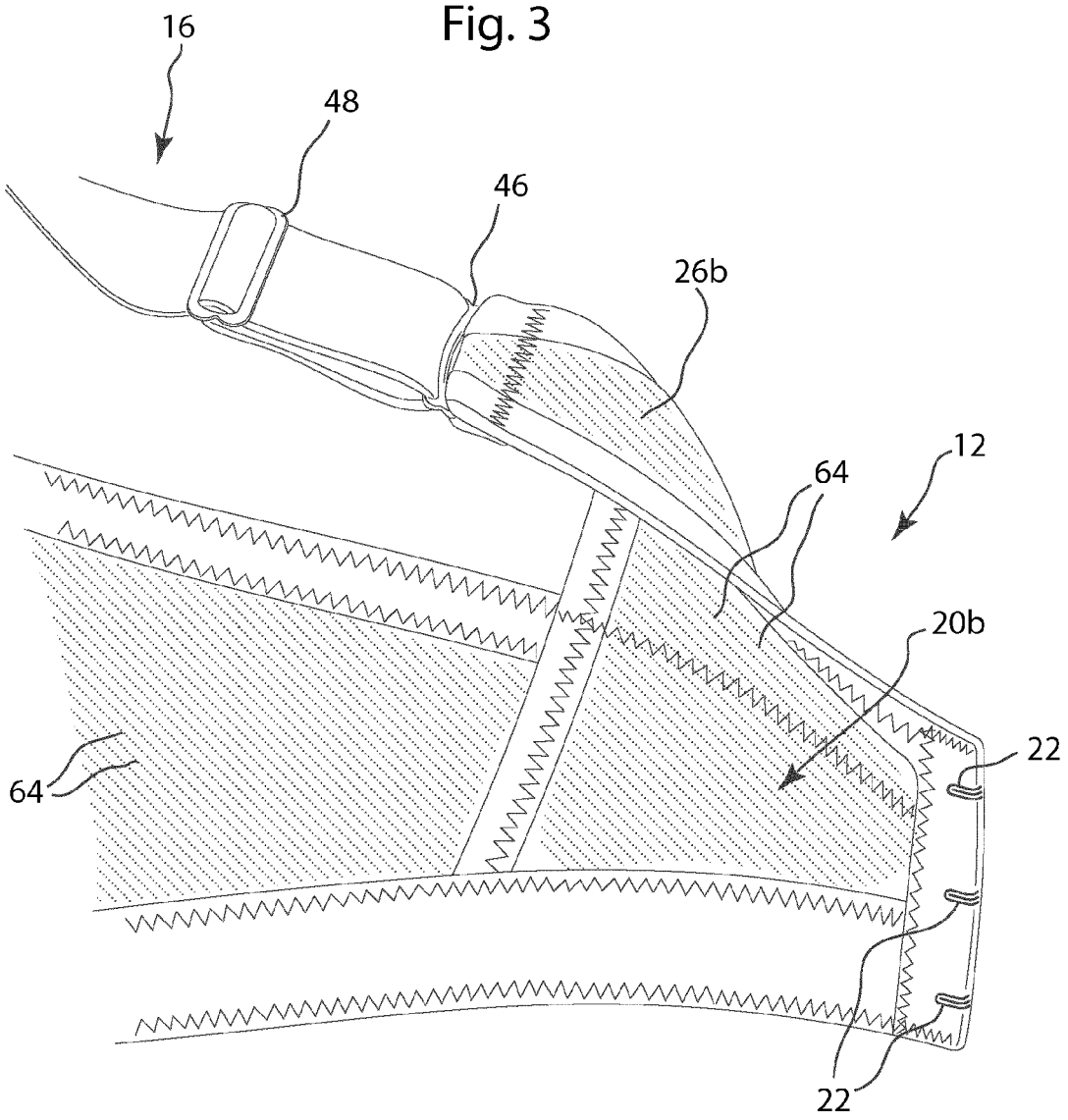
FIG. 3 is a rear inside view of the right back band of the sports bra depicted in FIG. 1.
Figure 4:
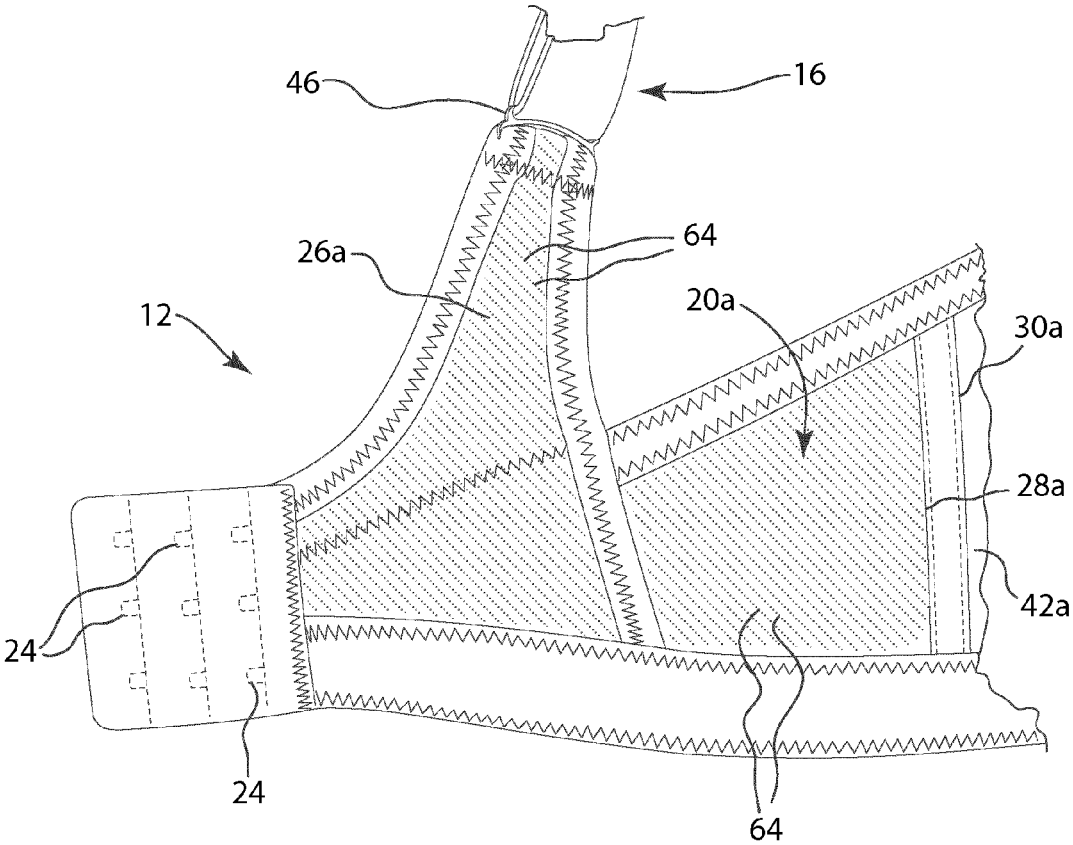
FIG. 4 is a rear inside view of the left back band of the sports bra depicted in FIG. 1.
Figure 5:
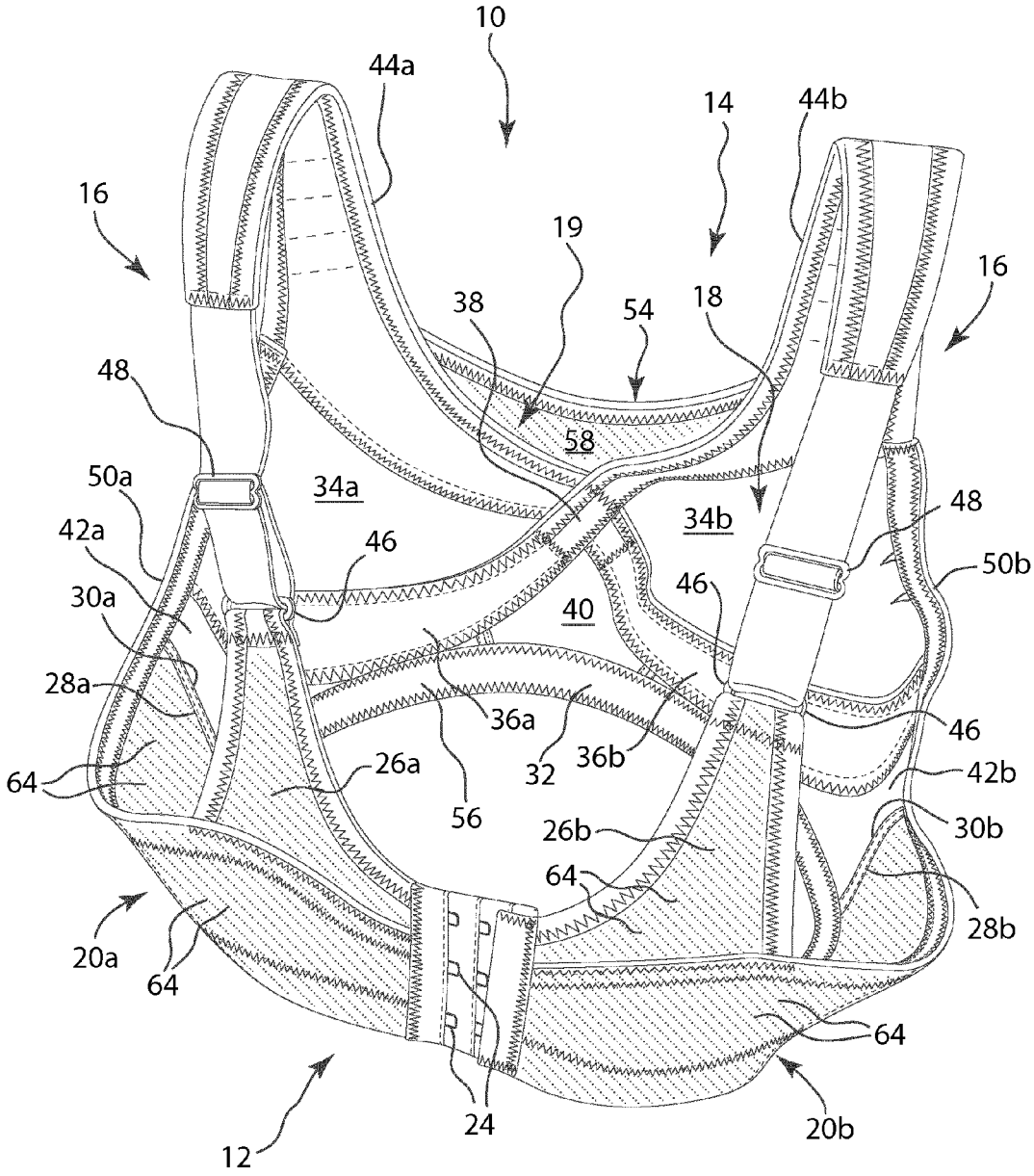
FIG. 5 is a back and top perspective view of the sports bra depicted in FIG. 1.

Back member 12 preferably includes left and right back bands 20*a* and 20*b* which extend across the back of the user and which are relatively wide in order to provide extra support during sports activities or the like. Bands 20 are adjustably connected together where they meet in the center, for example by a vertical series of three hooks 22 on right band 20*b* which are received in a respective column of three eyelets 24 on left band 20*a* as well known in the art. By the provision of three columns of eyelets 24 spaced longitudinally along left band 20*a*, the length of back member 12 is adjustable as well known in the art. As shown in FIGS. 3 and 4, back member 20 also includes left and right back extensions 26*a* and 26*b* which extend vertically from along a respective left and right back bands 20*a* and 20*b* and which are attached to strap system 16. Both back bands 20 and back extensions 26 are made of a relatively elastic material, which has a higher elastic modulus (greater restoring force) than strap system 16. Back member 12 thus provides a two way planar stretching thereof in use relative to strap system 16, and thus back member 12 acts in the manner of a racer back design to keep or help maintain the desired strap placement of strap system 16 in place and to provide comfortable (elastic) and wide area support along the back of the user. The inclusion of adjustments via strap sections 48 allow adjustment as is well known in the art but is not possible in a standard racer back design. Left and right back bands 20*a* and 20*b* end at respective left and right back ends or end portions 28*a* and 28*b*.

Inner cup supporting system 18 of front member 14 includes left and right front sides 30*a* and 30*b* which are attached to respective left and right back ends 28*a* and 28*b*. A rib band 32 extends across the bottom of front member 14 to connect left and right front sides 30*a* and 30*b*. Connected to rib band 32 are left and right cups 34*a* and 34*b* which extend upwardly therefrom, though alternately it could be considered that rib band 32 is simply made of bottom portions of cups 34. Cups 34 serve as encapsulation cups and are designed to receive a respective breast of the user therein to support the breast via encapsulation. Preferably, cups 34 are of a seamless molded design, with the molded cup being made of a mold material which can be rigid, semi-rigid or stretch material (but with an elastic modulus or restoring force which is lower than that of outer bust supporting system 19 as noted below). The seamless design serves to protect the breast from abrasion during activity. Preferably, cups 34 are also made of a material with moisture management properties (e.g., suitable moisture transparency or wicking proprieties) to increase wearer comfort.

In a preferred embodiment, cups 34 make use an angular inner (crossing) sling design to provide a maximum support and shape for an encapsulated cup type of support, but without making use of a wire or the like which can be too restrictive and uncomfortable when worn during activity. The angular design includes respective left and right cup slings 36*a* and 36*b* which are relatively non-elastic. Slings 36 effectively cross and are attached or connected to each other at a central overlapping or intersecting portion 38 near the top of where cups 34 meet each other, and which left and right cup slings 36*a* and 36*b* then extend along the bottom side of respective left and right cups 34*a* and 34*b* to the far side to support the associated cup 34 using an under-bust type design. This underbust (crossing slings) design distributes pressure or forces from the left and right cups 34*a* and 34*b* angularly to the opposite right and left sides of strap system 16 as shown, and hence ultimately as well to left and right shoulders due to left and right back extensions 26*a* and 26*b* attached along left and right back bands 20*a* and 20*b*. The underbust design also serves to connect cups 34 together, along with a small central connecting panel 40 provided as shown. Respective left and right connecting panels 42*a* and 42*b* also serve to connect respective left and right slings 36*a* and 36*b*, and hence left and right cups 34*a* and 34*b*, to back ends 28.

Figure 2:
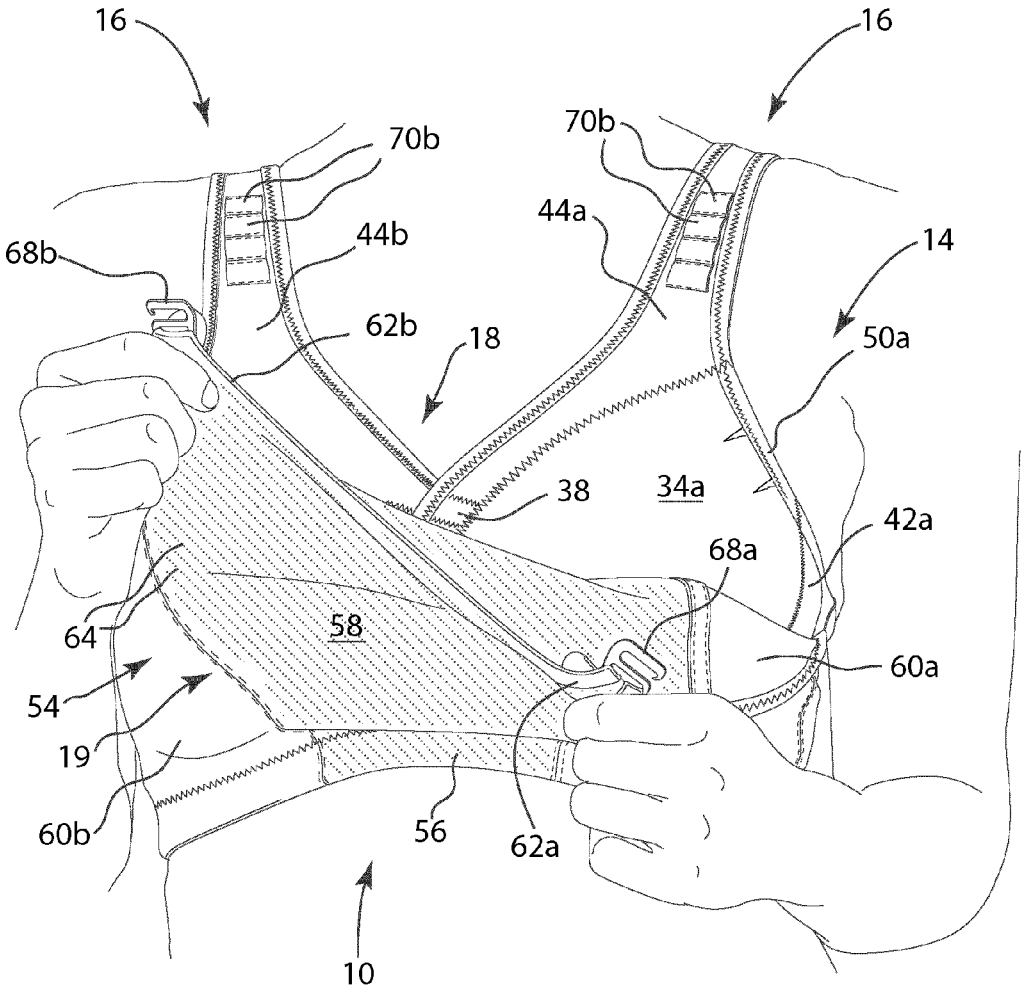
FIG. 2 is a front and left perspective view of the sports bra depicted in FIG. 1, but with the front compression panel held forward of the remainder of the sports bra.

Strap system 16 includes a front strap portion formed of left and right chest straps 44*a* and 44*b*, which are attached to intersecting portion 38 of slings 36 as well as along the remainder of the top of the associated left and right cups 34*a* and 34*b* to provide a long area of wide support along the top and inner portions of cups 34 as shown best in FIG. 2. Left and right straps 34*a* and 34*b* are respectively connected over the associated shoulders of the user to a back strap portion formed of left and right back extensions 26*a* and 26*b* to complete the support between cups 34 and back member 12. Strap system 16 is made of a relatively inelastic material and wide material in order to provide positive and wide area support, and straps system 16 is suitably padded if and where desirable. In addition, as well known in the art, the length of each strap 34 is adjustable by the provision of a loop fastener 46 and loop adjustment member 48 for the loop provided at the back end of each strap 44. Each left and right strap 44*a* and 44*b* also includes respective outside extensions 50*a* and 50*b* which are attached to and extend along the outside of respective cups 34*a* and 34*b*. Extensions 50 are made of an elastic material, and are attached to gathered outside portions of associated cups 34, a non-gathered end of associated slings 36, and a gathered part of connecting panels 42. Extensions 50 are relatively stretchable at the connections to cups 34 and connecting panels 42 for comfort, but not at slings 36.

Outer bust supporting system 19 of front member 14 includes a suitably bust shaped compression panel 54, which is designed to conform around and support the bust (i.e., both breasts) of the user by compression over top of cups 34. Compression panel 54 can be of molded or seamed construction as desired since it does not contact the breasts, and compression panel 54 is preferably made of a material or materials having moisture management properties (e.g., suitable moisture transparency or wicking proprieties). Compression panel 54 has a bottom portion 56 thereof which is attached along the length of rib band 32 which is below cups 34 and connecting panels 42, so that otherwise compression panel 54 acts independently of cups 34. Making up compression panel 54 are a central section 58 and left and right side sections 60*a* and 60*b* as shown, together defining a main section of compression panel 54. Sections 58 and 60 are all formed of an elastic material, with the elastic modulus or restoring force of central section 58 preferably being greater than the elastic modulus of left and right front sections 60*a* and 60*b*. Central section 58 is provided with left and right upper portions 62*a* and 62*b* as shown. For comfort, central section 58 can be provided with air breathing holes as shown schematically by the lines 64 of holes; which line 64 of holes can also be provided on back bands 20 and back extensions 26 as desired.

An attachment system or mechanism 66 is provided to adjustably attach respective upper portions 62*a* and 62*b* of central section 58 of compression panel 54 to respective left and right chest straps 44*a* and 44*b* of strap system 16. In this preferred embodiment, attachment system 66 includes left and right hook members 68*a* and 68*b* attached to respective upper portions 62*a* and 62*b* of central section 58. Attachment system 66 then also includes a series of hook receiving panels 70*a* and 70*b* provided at designed locations along left and right chest straps 44*a* and 44*b* above left and right outside extensions 50*a* and 50*b*. By positioning of hook members 68*a* and 68*b* in a selected hook receiving panel 70*a* and 70*b*, the compression exerted by compression panel 54 on left and right cups 34*a* and 34*b* and hence on the breasts of the user can be adjusted from lower to higher, to fit the desire or comfort of the user for each cup 34 individually and together. Other suitable attachment systems are also envisioned, such as associated hook and loop (VELCRO) fasteners or hook and eye fasteners (as used to connect back bands 20 together as described above) or the like as well known in the art.

Overall, it is preferred that the elastic modulus or restoring force of outer bust supporting system 19 is greater than that of inner cup supporting system 18. With this construction, inner cup supporting system 18 (including the under bust angular support provided by crossing slings 36) provides an encapsulation type of support for the breasts of the user; while outer bust supporting system 19 provides a shaped compression and vertical (non-angular) support for the breasts independent of the support of the inner cup supporting system 18. With these inner and outer supporting systems 18 and 19, the two respective angular and vertical types of support are relatively independent of one another, so that they together provide an advantageous support with two different and adapting support vectors (left-right or angular, and up-down or vertical) as the breasts move, and hence their load changes, during movements of the user. In particular, angular support is provided by inner cup supporting system which has the left breast angularly supported by right chest strap 44*b* due to left sling 36*a*, while vertical support is provided by outer bust supporting system which has the left breast supported by left chest strap 44*a* via compression panel 54 stretched there over (and, of course, in a similar manner the right breast is supported). The angular and non-angular or vertical support offers the most balanced and natural support possible and with adjustment as desired.

It will also be appreciated that back bands 20 integrate with straps 44 to provide: support of (encapsulation) cups 34, support of slings 36, and support of compression panel 54. By using inner cup supporting system 18 and outer bust supporting system 19, compression panel 54 offers a good support or positioning for chest straps 44. In addition, use of rib band 32 offers an optimal anchor point for both cups 34 and compression panel 54. This design also allows the amount of elasticity to be optimized for each supporting system 18 and 19. The net effect is better support for cups 34, more comfort for chest straps 44, and a better accommodation to a body in motion.

Although sports bra 10 has been depicted as being made of with various panels, straps, etc., it will be appreciated that many other designs are possible which will still achieve the desired results of the present invention as described above. It will also be appreciated that the various panels, etc. can be made integral (or connected securely together) by stitching, integral molding or otherwise as desired and known in the art to form the unitary sports bra of the present invention.

Thus, while the present invention has been described with respect to exemplary embodiments thereof, it will be understood by those of ordinary skill in the art that variations and modifications can be effected within the scope and spirit of the invention.

I claim:

1. A variable compression hybrid design sports bra comprising:

a back member which extends across a back of the user;

a front member having left and right front sides which are respectively attached to said back member, a rib band extending from said left front side to said right front side;

left and right cups which receive a respective left and right breast of the user therein, and which are connected to said rib band so as to extend above said rib band, and a shaped compression panel which covers and hence receives said left and right cups therein during use, which is made of an elastic material, which is connected to said rib band, and which has left and right upper front portions;

a shoulder strap system which connects said left and right cups to said back member; and an attachment system which adjustably attaches said left and right upper portions of said compression panel with said strap system to variably stretch said compression panel attached to said rib band over said left and right cups and thus to variably compress said left and right cups during use with said compression panel.

2. A variable compression hybrid design sports bra as claimed in claim 1:

wherein said left and right cups are made of a relatively non-elastic material; and wherein said compression panel is made of a relatively elastic material which has a higher elastic modulus than the non-elastic material of said left and right cups.

3. A variable compression hybrid design sports bra as claimed in claim 2, wherein said relatively non-elastic material of said cups has moisture management properties.

4. A variable compression hybrid design sports bra as claimed in claim 3, wherein said elastic material of said compression panel has moisture management properties, and said compression panel includes breathing holes in at least a central portion thereof.

5. A variable compression hybrid design sports bra as claimed in claim 1:

wherein said strap system includes left and right chest straps, and wherein said left and right cups include respective left and right slings, said left and right slings effectively crossing at and hence forming a central intersection whereby said central intersection and hence said left and right slings are then attached angularly to respective said right and left chest straps, and said left and right slings respectively extending angularly from the central intersection to underneath and around a respective said left and right cup to further support the associated said cup.

6. A variable compression hybrid design sports bra as claimed in claim 5, wherein said shoulder strap system is made of a relatively inelastic material; and wherein said back member:

includes left and right back bands which terminate in respective left and right back ends, and which are made of a relatively elastic material which has a higher elastic modulus than the non-elastic material of said strap system, includes left and right back extensions which extend vertically from a respective said left and right back band, which are attached at an upper end thereof to said strap system, and which are made of a relatively elastic material which has a higher elastic modulus than the relatively inelastic material of said strap system, and provides a two way planar stretching thereof in use relative to said strap system.

7. A variable compression hybrid design sports bra as claimed in claim 1, wherein said shoulder strap system is made of a relatively inelastic material; and wherein said back member:

includes left and right back bands which terminate in respective left and right back ends, and which are made of a relatively elastic material which has a higher elastic modulus than the non-elastic material of said strap system, includes left and right back extensions which extend vertically from a respective said left and right back band, which are attached at an upper end thereof to said strap system, and which are made of a relatively elastic material which has a higher elastic modulus than the relatively inelastic material of said strap system, and provides a two way planar stretching thereof in use relative to said strap system.

8. A variable compression hybrid design sports bra as claimed in claim 1, wherein said attachment system a) includes left and right chest straps, and b) individually adjusts i) said left upper portion of said compression panel with said left chest strap and ii) said right upper portion of said compression panel with said right chest strap.

9. A variable compression hybrid design sports bra as claimed in claim 1, wherein a length of said shoulder strap system is adjustable, and wherein a length of said back member is adjustable.

10. A variable compression hybrid design sports bra for the breasts of a user comprising:

left and right shoulder straps having respective left and right chest strap portions and a back portion;

a back member to which said back portion of said shoulder straps is integral, said back member including left and right back end portions;

left and right encapsulation cups for receiving the left and right breasts of the user having bottom portions, said left and right encapsulation cups being integral respectively with said left and right chest strap portions of said left and right shoulder straps and with said left and right back end portions of said back member;

a bust cup which is made of an elastic material that compresses said encapsulation cups, said bust cup having a lower portion which is integral with said bottom portions of said left and right encapsulation cups, a shaped main portion located outwardly over said left and right encapsulation cups, and an upper portion having left and right sides; and an attachment mechanism which adjustably attaches said left and right sides of said upper portion of said bust cup to respective said left and right chest portions of said left and right shoulder straps to variably compress said encapsulation cups.

11. A variable compression hybrid design sports bra as claimed in claim 10:

wherein said encapsulation cups are made of a relatively non-elastic material; and wherein said compression member is made of a relatively elastic material which has a higher elastic modulus than the non-elastic material of said encapsulation cups.

12. A variable compression hybrid design sports bra as claimed in claim 11, wherein a length of said left and right shoulder straps is adjustable, and wherein a length of said back member is adjustable.

13. A variable compression hybrid design sports bra as claimed in claim 12, wherein left and right encapsulation cups include respective left and right slings which effectively cross at and hence form a central intersection whereby said central intersection and hence said left and right slings are then attached to respective said right and left shoulder straps, and extend angularly from the central intersection thereof to underneath a respective said right and left encapsulation cup to further support the associated said encapsulation cup.

14. A variable compression hybrid design sports bra as claimed in claim 13, wherein said back member includes left and right back extensions which extend up from an associated part of said back member and to which respective said left and right shoulder straps are attached, said back member and said left and right back extensions being made of an elastic material so that a two way planar stretching thereof occurs in use.

15. A variable compression hybrid design sports bra as claimed in claim 14, wherein said material of said cups has moisture management properties.

16. A variable compression hybrid design sports bra as claimed in claim 15, wherein said elastic material of said compression panel has moisture management properties, and said compression panel includes breathing holes in at least a portion thereof.

17. A variable compression hybrid design sports bra comprising:

a back member which extends across a back of the user;

a front member which extends across the chest of the user and which is connected at each side to said back member; and a shoulder strap system which passes over the shoulders of the user to connect said front member to said back member;

said front member including a lower rib band extending along a bottom portion of said front member, left and right cups which are connected to said rib band so as to extend above said rib band, encapsulate a respective left and right breast of the user therein, have respective left and right slings along a bottom portion of the respective left and right cup to further support the associated said left and right cup, said left and right slings crossing and being attached angularly to said strap system, and a bust shaped compression panel which is inwardly concave shaped in order to receive said left and right cups comfortably therein during use, has left and right upper portions above said left and right cups received therein, is made of an elastic material, and is connected to said rib band; and an attachment system which adjustably attaches said left and right upper portions of said compression panel with said strap system to variably stretch said compression panel attached to said lower member over said left and right cups and thus to variably compress said left and right cups during use with compression panel.

18. A variable compression hybrid design sports bra as claimed in claim 17, wherein said shoulder strap system includes left and right straps; and wherein said back member includes left and right back extensions which extend up from an associated part of said back member and to which respective said left and right shoulder straps are attached, said back member and said left and right back extensions being made of an elastic material so that a two way planar stretching thereof occurs in use.

19. A variable compression hybrid design sports bra as claimed in claim 18:

wherein said left and right cups are made of a relatively non-elastic material; and wherein said compression panel is made of a relatively elastic material which has a higher elastic modulus than the non-elastic material of said left and right cups.

* * * * *